US009281597B2

(12) United States Patent
Hashiguchi

(10) Patent No.: US 9,281,597 B2
(45) Date of Patent: Mar. 8, 2016

(54) CONNECTOR

(71) Applicant: JAPAN AVIATION ELECTRONICS INDUSTRY, LIMITED, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 88 days.

(21) Appl. No.: 14/177,374

(22) Filed: Feb. 11, 2014

(65) Prior Publication Data

US 2014/0308825 A1 Oct. 16, 2014

(30) Foreign Application Priority Data

Apr. 11, 2013 (JP) ..... 2013-083037

(51) Int. Cl.

| | |
|---|---|
| ***H01R 12/00*** | (2006.01) |
| ***H01R 13/24*** | (2006.01) |
| ***H01R 12/77*** | (2011.01) |
| ***H01R 12/79*** | (2011.01) |
| *H01R 12/70* | (2011.01) |

(52) U.S. Cl.

CPC ..... *H01R 13/24* (2013.01); *H01R 12/774* (2013.01); *H01R 12/79* (2013.01); *H01R 12/707* (2013.01)

(58) Field of Classification Search

CPC ..... H05K 3/365

USPC ..... 439/67, 77, 495, 493, 494

See application file for complete search history.

(56) References Cited

U.S. PATENT DOCUMENTS

| | | | | |
|---|---|---|---|---|
| 3,436,715 | A * | 4/1969 | Matthews | 439/77 |
| 4,190,311 | A * | 2/1980 | Basta | G01R 1/0425 324/762.02 |
| 4,640,562 | A * | 2/1987 | Shoemaker | H01R 12/79 439/327 |
| 4,798,544 | A * | 1/1989 | Hartman | 439/404 |
| 4,948,378 | A * | 8/1990 | Hoshino | H01R 12/714 439/271 |
| 5,525,072 | A * | 6/1996 | Kunishi | 439/495 |
| 5,664,964 | A * | 9/1997 | Crofoot | H01R 43/24 439/495 |
| 5,842,873 | A * | 12/1998 | Gonzales | H01R 24/50 439/329 |
| 6,692,294 | B2 * | 2/2004 | Kobayashi | H01R 12/79 439/496 |
| 6,830,478 | B1 * | 12/2004 | Ko | H01R 13/6275 439/484 |
| 7,074,085 | B2 * | 7/2006 | Chen | H01R 23/6873 439/108 |

(Continued)

FOREIGN PATENT DOCUMENTS

| | | | |
|---|---|---|---|
| JP | H06-068940 | A | 3/1994 |
| JP | 2000-012129 | A | 1/2000 |
| JP | 2007-200624 | A | 8/2007 |

*Primary Examiner* — Neil Abrams

(74) *Attorney, Agent, or Firm* — Collard & Roe, P.C.

(57) ABSTRACT

A connector comprises a plurality of contacts which are formed using a plurality of conductive contact points provided on a first plate surface of an FPC as a connection object, a frame member which has an opening size and a height capable of receiving a mating connector and is attached to the first plate surface of the FPC so as to surround the contacts, and a plate-like member which is provided on a second plate surface of the FPC so as to extend over a region corresponding to the contacts. The frame member has locking holes which respectively engage with mating locking claws of the mating connector when the connector is fitted to the mating connector, thereby maintaining the fitting state of the connector and the mating connector.

11 Claims, 8 Drawing Sheets

(56) References Cited

U.S. PATENT DOCUMENTS 7,156,678 B2 * 1/2007 Feldman et al. ..... 439/326
7,244,139 B2 * 7/2007 Ono ..... H01R 12/67 439/417
7,273,390 B2 * 9/2007 Iida ..... H01R 43/16 439/357
7,309,237 B2 * 12/2007 Kuo ..... H01R 13/6593 439/495
7,331,812 B2 * 2/2008 Nishio ..... H01R 13/639 439/331
7,351,100 B2 * 4/2008 Yodogawa ..... 439/579
7,371,095 B2 * 5/2008 Takahashi ..... 439/261
7,377,803 B2 * 5/2008 Matsuoka ..... H01R 12/592 439/497
7,553,167 B2 * 6/2009 Zhang ..... H01R 4/2433 439/497
7,654,829 B1 * 2/2010 Chuang et al. ..... 439/67
7,722,398 B2 * 5/2010 Ma ..... H01R 12/592 439/493
7,815,467 B2 * 10/2010 Tsuchida ..... H01R 12/716 439/579
7,828,585 B2 * 11/2010 Kurimoto ..... 439/468
7,878,850 B2 * 2/2011 Wu ..... H01R 13/6581 439/497
7,883,364 B2 * 2/2011 Wu ..... H01R 9/032 439/578
7,896,688 B2 * 3/2011 Sukegawa et al. ..... 439/494
7,946,882 B2 * 5/2011 Wu ..... H01R 13/648 439/108
7,988,459 B2 * 8/2011 Ulen et al. ..... 439/73
8,043,114 B2 * 10/2011 Kaneko et al. ..... 439/497
8,075,324 B2 * 12/2011 Yamaji ..... H01R 13/6295 439/188
8,133,070 B2 * 3/2012 Hsueh ..... H01R 9/03 439/497
8,465,324 B2 * 6/2013 Ikari ..... H01R 12/79 439/495
8,523,603 B2 * 9/2013 Yamaji ..... H01R 12/57 439/493
8,602,812 B2 * 12/2013 Ohsaka ..... H01R 12/775 439/497
8,894,433 B2 * 11/2014 Little ..... H01R 12/7005 439/378
8,939,794 B2 * 1/2015 Mason ..... H01R 9/0515 439/581
9,048,569 B2 * 6/2015 Chen ..... H01R 12/716
9,077,127 B2 * 7/2015 Iwano ..... H01R 12/777
9,112,302 B2 * 8/2015 Liao ..... H01R 12/598
2009/0227138 A1 * 9/2009 Lv ..... H01R 12/79 439/466
2011/0306229 A1 * 12/2011 Katsui et al. ..... 439/345
2014/0308825 A1 * 10/2014 Hashiguchi ..... H01R 12/79 439/66

* cited by examiner

CONNECTOR

This application is based upon and claims the benefit of priority from Japanese Patent Application No. 2013-083037, filed on Apr. 11, 2013, the disclosure of which is incorporated herein in its entirety by reference.

BACKGROUND OF THE INVENTION

1. Field of the Invention

This invention relates to a connector which is attached to a connection object such as an FPC or a circuit board and adapted to be fitted to a mating connector, mounted on a surface of a mating connection object such as a circuit board, in a direction perpendicular to the surface of the mating connection object, thereby electrically connecting the connection object to the mating connection object, and in particular, this invention relates to the connector which uses, as its contacts, conductive contact points themselves provided on the connection object.

2. Description of Related Art

A connector system that electrically connects an FPC (Flexible Printed Circuit) or an FFC (Flexible Flat Cable) (hereinafter collectively referred to as an "FPC") as a connection object to a circuit board (hereinafter referred to as a "PCB (Printed Circuit Board)") as a mating connection object is disclosed, for example, in JP-A-2007-200624 (Patent Document 1) or JP-A-2000-012129 (Patent Document 2).

According to the connector system disclosed in Patent Document 1, an FPC as a connection object is not provided with a connector and the FPC itself is fitted to a connector (as a matter of convenience, referred to as a "mating connector"), mounted on a surface of a PCB as a mating connection object, in a direction parallel to the surface of the PCB (hereinafter may also be referred to as a "horizontal fitting type"), thereby electrically connecting the FPC to the PCB. The mating connector comprises a frame member, an insulating elastic plate having a plurality of projections, and a presser plate and is complicated in structure. However, contacts in this mating connector are formed using a plurality of conductive contact points themselves formed on the PCB as the mating connection object.

The connector system disclosed in Patent Document 2 comprises a connector and a mating connector. The connector comprises an insulator which is attached to a free end of a flat cable, as a connection object, formed by integrating a plurality of coated wires, and a plurality of contacts fixed to the insulator. On the other hand, the mating connector comprises a frame member which is mounted on a PCB as a mating connection object. Contacts in this mating connector are formed using a plurality of conductive contact points (conductor pattern end portions) themselves formed on the PCB as the mating connection object. The connector attached to the FPC as the connection object is of the horizontal fitting type that is fitted to the mating connector in a direction parallel to a surface of the PCB as the mating connection object. The connector system disclosed in Patent Document 2 has the connectors on both the connection object and the mating connection object, respectively, and thus is complicated in structure as a connector system.

On the other hand, JP-A-H06-068940 (Patent Document 3) discloses a connector which is, as opposed to those disclosed in Patent Documents 1 and 2, adapted to be fitted to a mating connector, mounted on a surface of a mating connection object, in a direction perpendicular to the surface of the mating connection object (hereinafter may also be referred to as a "perpendicular fitting type").

The connector disclosed in Patent Document 3 comprises a reinforcing plate bonded to one of plate surfaces (a rear surface in a fitting direction) of an FPC as a connection object. This reinforcing plate has engaging projections respectively protruding from its both sides.

A plurality of contacts in this connector are formed using a plurality of conductive contact points (conductor pattern end portions) themselves formed on the FPC as the connection object. Therefore, the connector is simple in structure.

The mating connector disclosed in Patent Document 3 comprises an insulator which is mounted on a PCB as a mating connection object, locking members each having an engaging hole and fixed to the insulator, and a plurality of contacts press-fitted into the insulator and adapted to be brought into pressure contact with the conductive contact points, as the contacts of the connector, of the FPC.

The connector is fitted to the mating connector in a direction perpendicular to a surface of the PCB as the mating connection object. The fitting state of the connector and the mating connector is maintained by engagement of the engaging projections of the connector with the engaging holes of the locking members of the mating connector. While the connector and the mating connector are fitted together, the contacts of the mating connector are in pressure contact with the conductive contact points, as the contacts of the connector, of the FPC so that conductive contact points of the PCB and the conductive contact points of the FPC are electrically connected to each other.

In the connector disclosed in Patent Document 3, the reinforcing plate holds the FPC having the conductive contact points as the contacts of the connector. Specifically, when the connector is fitted to the mating connector, the contacts of the mating connector are brought into pressure contact with the conductive contact points of the FPC. In this event, if the FPC, particularly a region where the conductive contact points are formed, is bent due to the pressing force of the mating connector so that its flat surface cannot be maintained, contact failure occurs between the conductive contact points of the FPC and the contacts of the mating connector. As a result, electrical connection between the connection objects is not established properly. Particularly in the case of a so-called multicore connector with many contacts, the pressing force of contacts of a mating connector becomes considerably large so that a reinforcing plate of the connector should have a correspondingly high strength. Accordingly, in the connector disclosed in Patent Document 3, the required strength is obtained by setting the thickness of the reinforcing plate to be fairly large.

On the other hand, the circumstances are such that miniaturization and lower profile of an electronic device such as a smartphone to which this type of connector is applied have been advanced more and more and thus that miniaturization, lower profile, and higher density mounting are required also for components, including the connector, of the electronic device. Under these circumstances, it is not preferable to increase the thickness of the reinforcing plate of the connector.

It is therefore an object of this invention to provide a connector of the perpendicular fitting type which is simple in structure and, in addition, which is small in size and low-profile.

SUMMARY

According to the present invention, a connector which is attached to a plate-like connection object and adapted to be fitted to a mating connector, mounted on a surface of a mating connection object, in a direction perpendicular to the surface of the mating connection object, thereby electrically connecting the connection object to the mating connection object, the connector comprising: a plurality of contacts formed on a first plate surface of the connection object; a frame-shaped frame member which has an opening size and a height capable of receiving the mating connector and is attached to the first plate surface of the connection object so as to surround the plurality of contacts; and a plate-like member which is provided on a second plate surface of the connection object so as to extend over a region corresponding to the plurality of contacts and is joined to the frame member, wherein the frame member has a locking portion which engages with a mating locking portion provided in the mating connector when the connector is fitted to the mating connector, thereby maintaining a fitting state of the connector and the mating connector is provided.

The frame member may be made of a metal and soldered to metal lands formed at positions, surrounding the plurality of contacts, on the first plate surface of the connection object so that the frame member is joined to the plate-like member through the connection object.

The frame member may have a shape in which a portion, corresponding to the metal land of the connection object, of the frame member is projected outward.

The metal land of the connection object may be electrically connected to a ground pattern formed on the connection object. In this case, the frame member may be electrically connected to the ground pattern through the metal land.

The connection object may be a circuit board. In this case, the plate-like member may be formed using the circuit board itself.

The frame member may have a frame-side engaging portion and the plate-like member may have a plate-like member-side engaging portion adapted to engage with the frame-side engaging portion. In this case, the frame member and the plate-like member may be joined together by engagement between the frame-side engaging portion and the plate-like member-side engaging portion in a state where the connection object is sandwiched between the frame member and the plate-like member.

One side of the frame member and one side of the plate-like member may be joined to each other through a hinge portion so that the frame member and the plate-like member can be opened and closed. In this case, by engagement between the frame-side engaging portion and the plate-like member-side engaging portion in a state where the frame member and the plate-like member are closed to each other about the hinge portion so as to sandwich the connection object therebetween, the frame member and the plate-like member may be joined to each other also at a portion other than along the sides thereof.

The frame member, the plate-like member, and the hinge portion may be in the form of a single component formed by using a common material.

A ground pattern may be formed on the second plate surface of the connection object, including its region corresponding to the plurality of contacts formed on the first plate surface of the connection object. In this case, the frame member, the plate-like member, and the hinge portion may be each made of a metal, and the frame member may be electrically connected to the ground pattern through the hinge portion and the plate-like member.

A connector system may comprise the connector mentioned above and the mating connector.

The connector according to this invention is simple in structure and, in addition, is small in size and low-profile.

DETAILED DESCRIPTION OF THE PREFERRED EMBODIMENTS

A connector according to this invention is a connector of the perpendicular fitting type which is attached to a plate-like connection object such as an FPC and adapted to be fitted to a mating connector, mounted on a surface of a mating connection object such as a PCB, in a direction perpendicular to the surface of the mating connection object, thereby electrically connecting the connection object to the mating connection object. The connector has a plurality of contacts which are formed using a plurality of conductive contact points arranged side by side on a first plate surface of the connection object.

In particular, the connector comprises a frame member and a plate-like member.

The frame member has a frame shape having an opening size and a height capable of receiving the mating connector and is attached to the first plate surface of the connection object so as to surround the contacts.

The plate-like member is provided on a second plate surface of the connection object so as to extend over a region corresponding to the contacts and is joined to the frame member.

The frame member has a concave or convex locking portion which engages with a convex or concave mating locking portion provided in the mating connector when the connector is fitted to the mating connector, thereby maintaining the fitting state of the connector and the mating connector.

In the connector, with the above-mentioned configuration, particularly with the configuration that the plate-like member holding the connection object is joined to the frame member, the plate-like member exhibits the strength equivalent to that of a plate-like member with an increased thickness equal to the sum of the height of the frame member and the thickness of the plate-like member. Further, since the frame member has the shape adapted to receive the mating connector, in other words, the shape adapted to cover the mating connector, only the plate-like member is present above the mating connector when the connector is fitted to the mating connector. Accordingly, a connector system as a combination of the connector and the mating connector is low-profile.

Hereinbelow, embodiments of connectors according to this invention will be described with reference to the drawings.

First Embodiment

Figure 1:
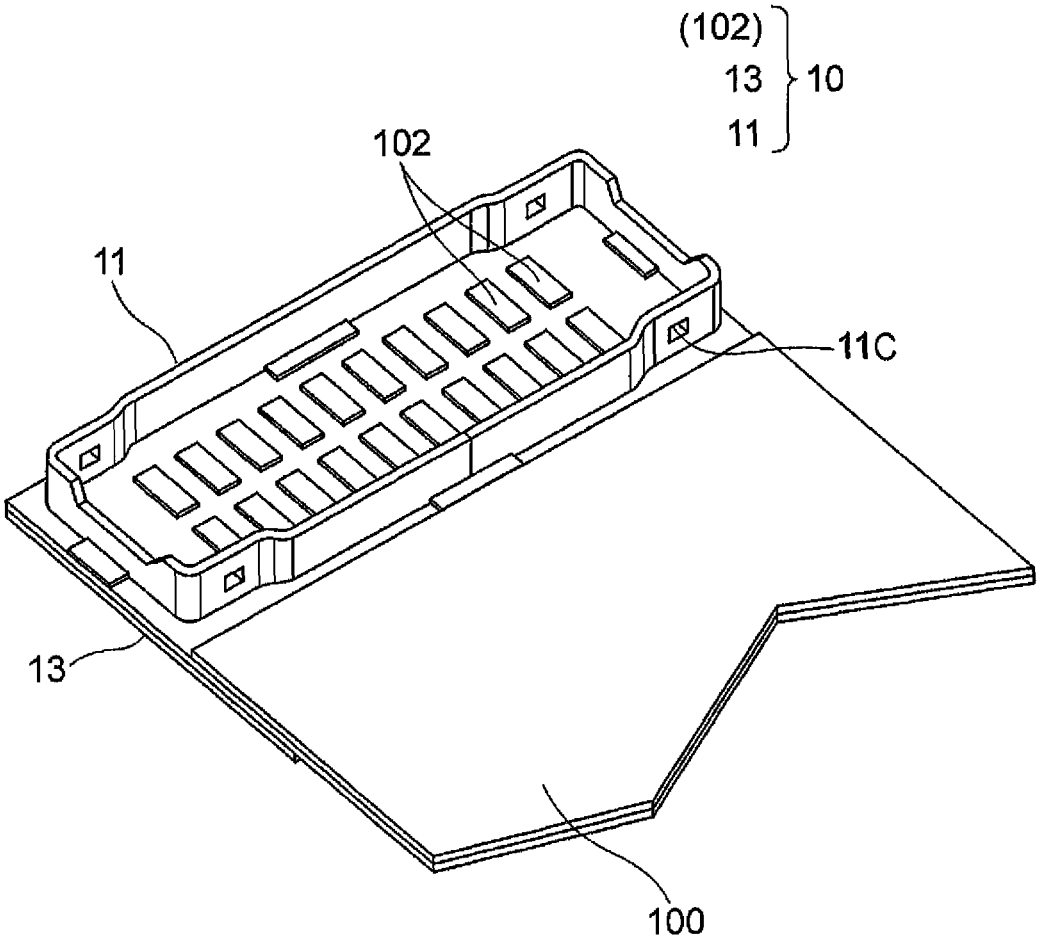
FIG. 1 is a perspective view showing a state where a connector according to a first embodiment of this invention is applied to a connection object.
Figure 2:
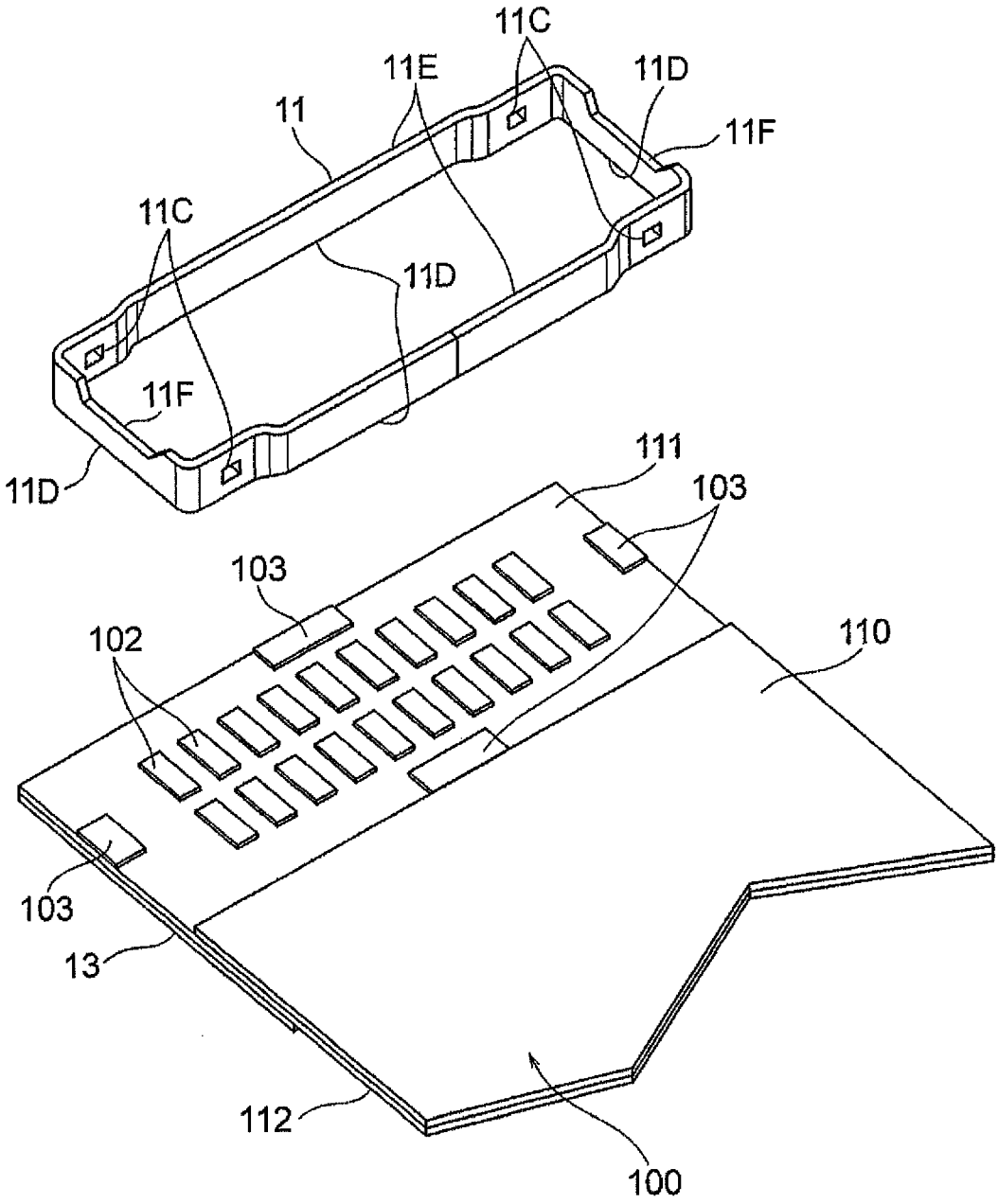
FIG. 2 is a perspective view showing a state where part of the connector shown in FIG. 1 is separated from the connection object.
Figure 3:
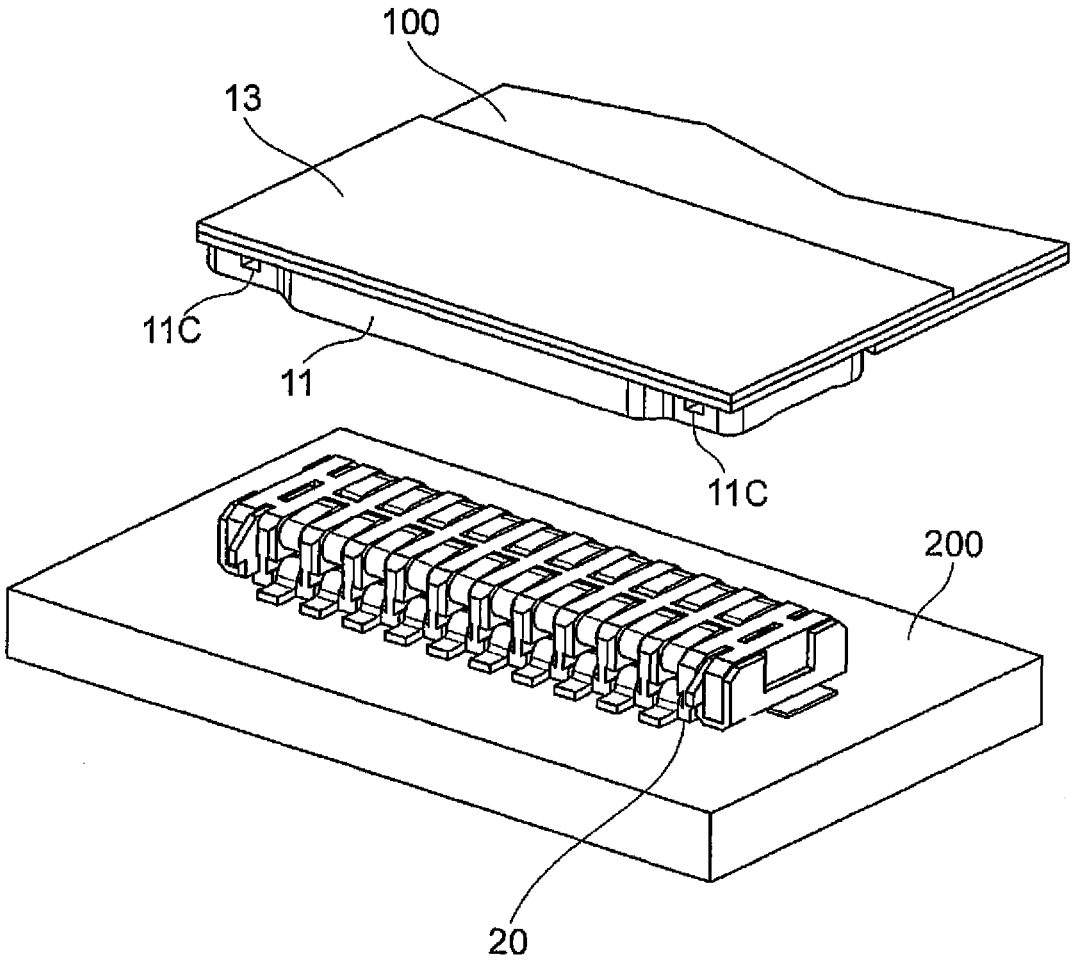
FIG. 3 is a perspective view when fitting the connector shown in FIG. 1 to a mating connector.

Referring to FIGS. 1 to 3, a connector 10 according to a first embodiment of this invention is a connector of the perpendicular fitting type which is attached to an FPC 100 as a plate-like connection object and adapted to be fitted to a mating connector 20, mounted on a surface of a PCB 200 as a mating connection object, in a direction perpendicular to the surface of the PCB 200, thereby electrically connecting the FPC 100 to the PCB 200.

The connector 10 comprises a plurality of contacts 102, a frame member 11, and a plate-like member 13.

The contacts 102 are formed using a plurality of conductive contact points arranged side by side on a first plate surface 111 of the FPC 100. The conductive contact points of the FPC 100 are each illustrated to have a land shape in the figures, but are actually formed by respective end portions of a plurality of non-illustrated wiring patterns extending in a longitudinal direction of the FPC 100. These wiring patterns are formed so as to bypass later-described metal lands 103 formed on the first plate surface 111 of the FPC 100.

The frame member 11 has a frame shape having an opening size and a height capable of receiving the mating connector 20 and is attached to the first plate surface 111 of the FPC 100 so as to surround the contacts 102.

The frame member 11 has locking holes 11C. The locking holes 11C are concave portions that respectively engage with later-described locking claws 23C (FIG. 4) as convex mating locking portions provided in the mating connector 20 when the connector 10 is fitted to the mating connector 20, thereby maintaining the fitting state of the connector 10 and the mating connector 20.

The plate-like member 13 is, for example, a polyimide plate or a stainless steel plate and is bonded to a second plate surface 112 of the FPC 100 so as to extend over a region corresponding to the contacts 102. As will be described later, the plate-like member 13 is mechanically joined to the frame member 11. The plate-like member 13 is equivalent to a lead plate of an FPC with lead plate for use with a connector of the type into which the FPC with lead plate is press-fitted, and therefore, the plate-like member 13 can be easily manufactured using existing manufacturing facilities for the FPC with lead plate. The thickness of the plate-like member 13 is not required to be as large as that of the reinforcing plate of Patent Document 3 and is sufficient if it is as large as that of the above-mentioned lead plate.

As a modification of this embodiment, if a connection object of a connector is not an FPC but a PCB, the connector can be formed using the PCB itself as a plate-like member without additionally providing an independent component such as the plate-like member 13 to the connector.

The frame member 11 is made of a metal. In the illustrated example, four soldering portions 11D of the frame member 11 are soldered to the four metal lands 103 formed at positions, surrounding the contacts 102, on the first plate surface 111 of the FPC 100. With this configuration, the frame member 11 is joined to the plate-like member 13 through the FPC 100 so that the plate-like member 13 exhibits the strength equivalent to that of a plate-like member with an increased thickness equal to the sum of the height of the frame member 11 and the thickness of the plate-like member 13.

The frame member 11 has a pair of extended portions 11E each having a shape in which a portion, corresponding to the metal land 103 of the FPC 100, of the frame member 11 is projected outward. With this configuration, even if solder is swollen inside the frame member 11 when the soldering portions 11D are soldered to the metal lands 103, it is prevented that the swollen solder interferes with the mating connector 20 to disable proper fitting between the connector 10 and the mating connector 20 when the connector 10 is fitted to the mating connector 20.

The metal lands 103 of the FPC 100 may be electrically connected to a non-illustrated ground pattern formed on the first plate surface 111 of the FPC 100 or may be electrically connected through vias to a non-illustrated ground pattern formed on the second plate surface 112 of the FPC 100. In this case, the frame member 11 is electrically connected to the ground pattern through the metal lands 103. Likewise, the plate-like member 13 may be made of a conductive metal and electrically connected to a non-illustrated ground pattern formed on the second plate surface 112 of the FPC 100. In this case, in order to ensure reliable contact between the ground pattern of the FPC 100 and the plate-like member 13, a plurality of projections or a plurality of spring pieces may be provided on an inner surface of the plate-like member 13, preferably at positions corresponding to the contacts 102. By electrically connecting at least one of the frame member 11 and the plate-like member 13 to the ground pattern of the FPC 100, the connector 10 and the mating connector 20 received therein can exhibit a shielding effect against noise coming from the outside and/or noise radiated to the outside.

Figure 4:
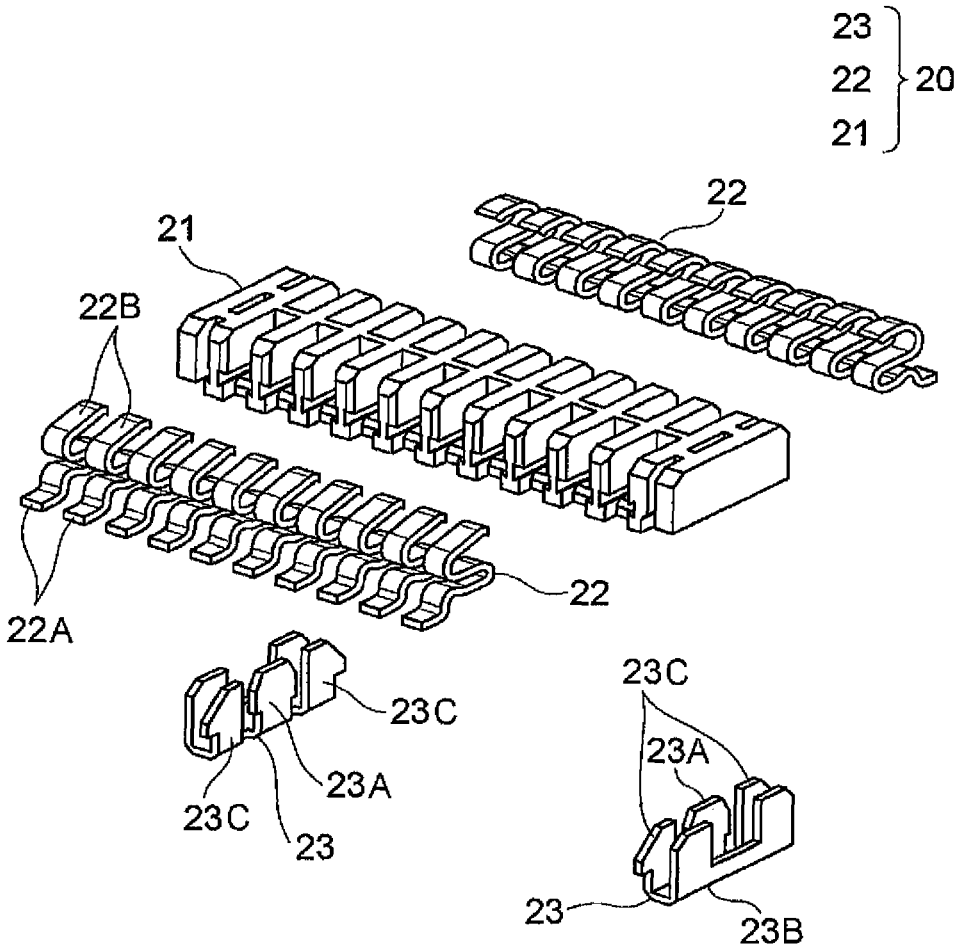
FIG. 4 is an exploded perspective of the mating connector shown in FIG. 3.
Figure 5:
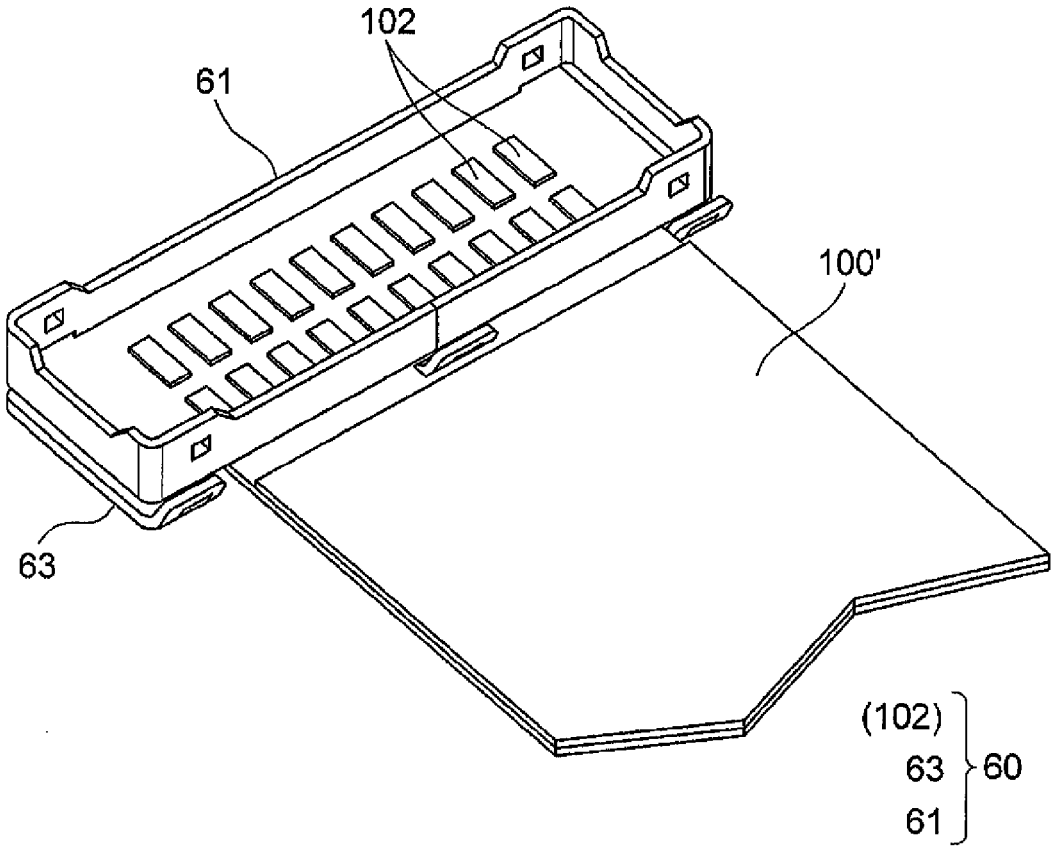
FIG. 5 is a perspective view showing a state where a connector according to a second embodiment of this invention is applied to a connection object, wherein the illustration of engaging claws 61H is omitted.

Referring to FIGS. 3 and 4, the mating connector 20 which is mounted on the surface of the PCB 200 as the mating connection object comprises a housing 21, a plurality of contacts 22, and locking members 23.

Each contact 22 is an S-shaped elastic terminal made of a conductive metal and is press-fitted into the housing 21. When the connector 10 is fitted to the mating connector 20, the contacts 22 are respectively brought into pressure contact with the contacts 102 of the connector 10. Each contact 22 has a terminal portion 22A which is soldered to a corresponding one of wiring pattern end portions as non-illustrated conductive contact points of the PCB 200, and a contact portion 22B which is electrically connected to a corresponding one of the contacts 102 when the connector 10 is fitted to the mating connector 20.

Each locking member 23 is an elastic member made of a metal. The locking members 23 are press-fitted into the housing 21 so as to be respectively located at both ends in a width direction of the mating connector 20. Each locking member 23 has a press-fitting portion 23A which is press-fitted into the housing 21, a base portion 23B which is soldered to a metal land formed on the PCB 200, and the convex locking claws 23C which respectively engage with the concave locking holes 11C of the frame member 11 of the connector 10 when the connector 10 is fitted to the mating connector 20. When detaching the connector 10 from the mating connector 20, the locking claws 23C are bent inward so that the engagement of the locking claws 23C with the locking holes 11C of the connector 10 can be released. The locking members 23 and the metal lands of the PCB 200 may be made of a conductive metal and the metal lands may be electrically connected to a non-illustrated ground pattern formed on the PCB 200, thereby electrically connecting the locking members 23 to the ground pattern. When the connector 10 is fitted to the mating connector 20, the locking claws 23C of the locking members 23 and the locking holes 11C of the frame member 11 are brought into contact with each other and therefore a connector system as a whole, comprising the connector 10 and the mating connector 20, can exhibit a shielding effect against noise coming from the outside and/or noise radiated to the outside.

As shown in FIG. 2, the frame member 11 of the connector 10 is provided with cutout portions 11F at positions corresponding to the base portions 23B, soldered to the metal lands of the PCB 200, of the locking members 23. With this configuration, it is prevented that when the connector 10 is fitted to the mating connector 20, solder adhering to the base portions 23B of the locking members 23 interferes with the frame member 11 of the connector 10 to disable proper fitting between the connector 10 and the mating connector 20.

Second Embodiment

Referring to FIGS. 5 to 8, a connector 60 according to a second embodiment of this invention differs from the connector 10 of the first embodiment in that the connector 60 is a single component in which a frame member 61 and a plate-like member 63 are joined together in advance. Accordingly, the drawings and description of the first embodiment will be referred to, thereby omitting a detailed description of the structures and operations which are the same as or similar to those of the first embodiment.

As in the first embodiment, the connector 60 is a connector of the perpendicular fitting type which is attached to an FPC 100' as a plate-like connection object and adapted to be fitted to a mating connector 20, mounted on a surface of a PCB 200 as a mating connection object, in a direction perpendicular to the surface of the PCB 200, thereby electrically connecting the FPC 100' to the PCB 200.

The PCB 200 and the mating connector 20 mounted thereon are the same as those shown in FIGS. 3 and 4 in the first embodiment.

The connector 60 comprises a plurality of contacts 102, the frame member 61, the plate-like member 63, and a hinge portion 64 joining together one side of the frame member 61 and one side of the plate-like member 63 so that the frame member 61 and the plate-like member 63 can be opened and closed. The frame member 61, the plate-like member 63, and the hinge portion 64 are in the form of a single component formed by using a common metal plate. This metal plate is made of a conductive metal material for a reason described later and may have flexibility and/or elasticity.

Since the frame member 61 and the plate-like member 63 are portions of the single component including the hinge portion, they are preferably referred to as a frame portion and a plate-like portion, respectively. However, in this specification, they are respectively referred to as members as a matter of convenience.

As in the first embodiment, the contacts 102 are formed using a plurality of conductive contact points arranged side by side on a first plate surface 111 of the FPC 100'. The conductive contact points of the FPC 100' are each illustrated to have a land shape in the figures, but are actually formed by respective end portions of a plurality of non-illustrated wiring patterns extending in a longitudinal direction of the FPC 100'. These wiring patterns are formed so as to bypass a later-described cutout (hole) 105 formed in the FPC 100'.

As in the first embodiment, the frame member 61 has a frame shape having an opening size and a height capable of receiving the mating connector 20 and is attached to the FPC 100' so as to surround the contacts 102. However, an attaching method differs from that in the first embodiment.

Figure 7:
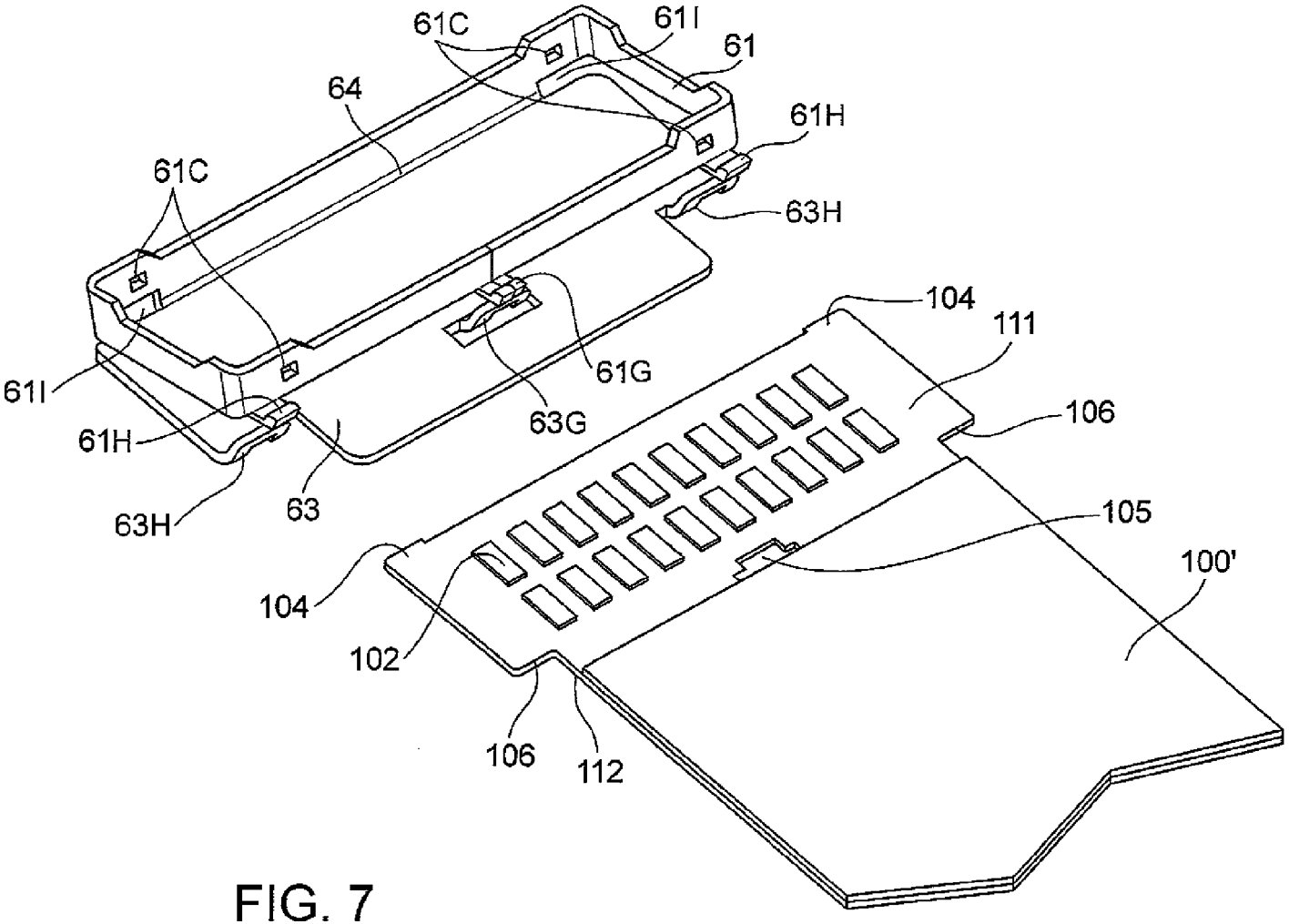
FIG. 7 is a perspective view when applying the connector shown in FIG. 5 to the connection object.
Figure 8:
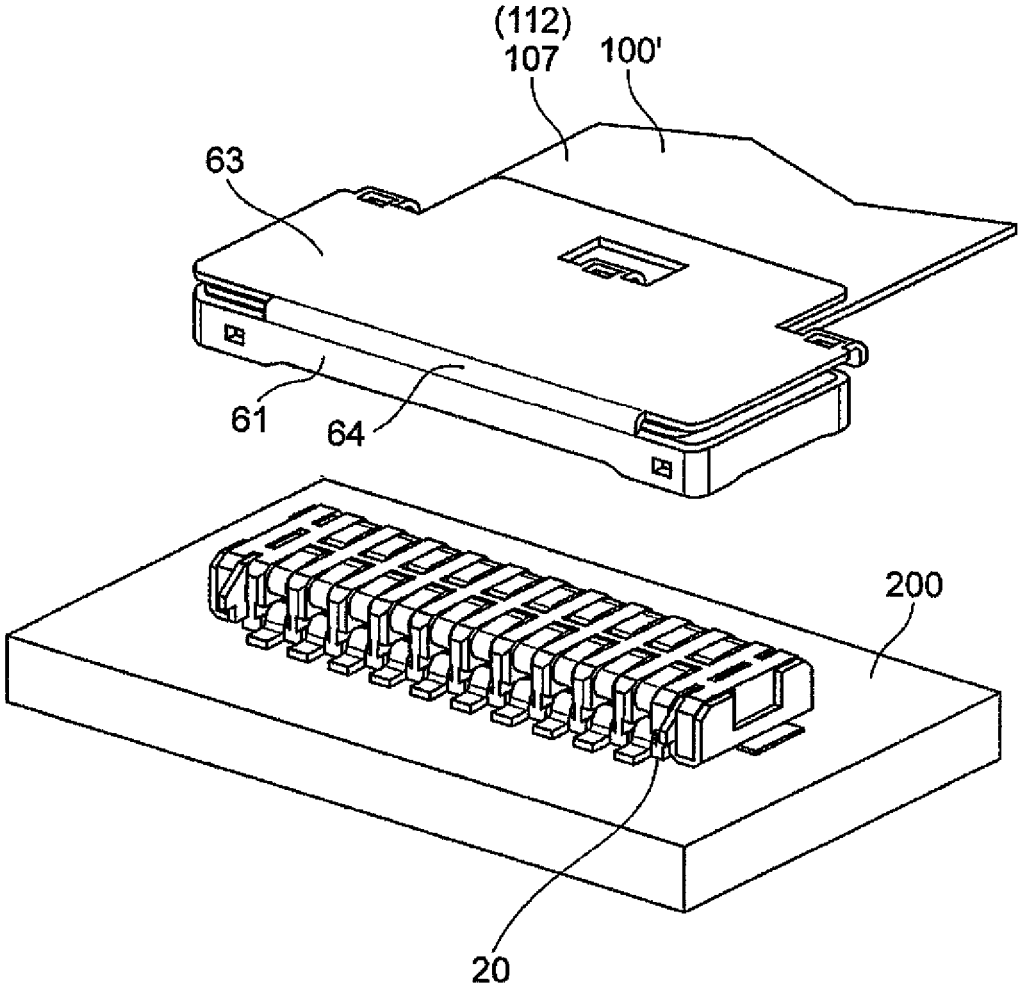
FIG. 8 is a perspective view when fitting the connector shown in FIG. 5 to a mating connector, wherein the illustration of the engaging claws 61H is omitted.

As described above, the frame member 61 and the plate-like member 63 are joined together in advance along the sides thereof through the hinge portion 64 so as to be openable and closable. The frame member 61 has engaging claws 61G and 61H as frame-side engaging portions. On the other hand, the plate-like member 63 has protruding portions formed with engaging holes 63G and 63H as plate-like member-side engaging portions which respectively engage with the engaging claws 61G and 61H. The frame-side engaging portions and the plate-like member-side engaging portions may be reversed in structure, that is, the frame member 61 may have protruding portions formed with engaging holes as frame-side engaging portions while the plate-like member 63 may have engaging claws as plate-like member-side engaging portions. As shown in FIG. 7, the FPC 100' has the cutout (hole) 105 and protruding portions 106. The cutout (hole) 105 and the protruding portions 106 have shapes that respectively allow engagement between the engaging claw 61G and the engaging hole 63G and engagement between the engaging claw 61H and the engaging hole 63H and that prevent unwanted decomposition of an assembly in the state where the FPC 100' is sandwiched by a connector component comprising the frame member 61, the plate-like member 63, and the hinge portion 64, in other words, in the state where such a connector component is attached to the FPC 100' as the connection object. The cutout (hole) 105, the protruding portions 106, and the protruding portions formed with the engaging holes 63G and 63H jointly serve as a stopper for the FPC 100' in its extraction direction with respect to the frame member 61 and further as a positioning means for the FPC 100' in its width direction with respect to the frame member 61. The FPC 100' further has a pair of projections 104. When the FPC 100' is sandwiched by the connector component, the projections 104 respectively enter cutouts 61I formed at both ends of the hinge portion 64. With this configuration, it is possible to carry out positioning of the FPC 100' in both its insertion and width directions with respect to the frame member 61.

Accordingly, by the engagement between the engaging claws 61G and 61H and the engaging holes 63G and 63H in the state where the frame member 61 and the plate-like member 63 are closed to each other about the hinge portion 64 so as to sandwich the FPC 100' therebetween, the frame member 61 and the plate-like member 63 are joined together also at the portions other than along the sides thereof. With this configuration, the plate-like member 63 exhibits the strength equivalent to that of a plate-like member with an increased thickness equal to the sum of the height of the frame member 61 and the thickness of the plate-like member 63. Therefore, the thickness of the plate-like member 63 is not required to be as large as that of the reinforcing plate of Patent Document 3 and, because of the single component, the frame member 61 also has the same thickness.

As in the first embodiment, the frame member 61 has locking holes 61C. The locking holes 61C are concave portions that respectively engage with locking claws 23C, as convex mating locking portions, of locking members 23 (FIG. 4) provided in the mating connector 20 when the connector 60 is fitted to the mating connector 20, thereby maintaining the fitting state of the connector 60 and the mating connector 20.

Figure 6:
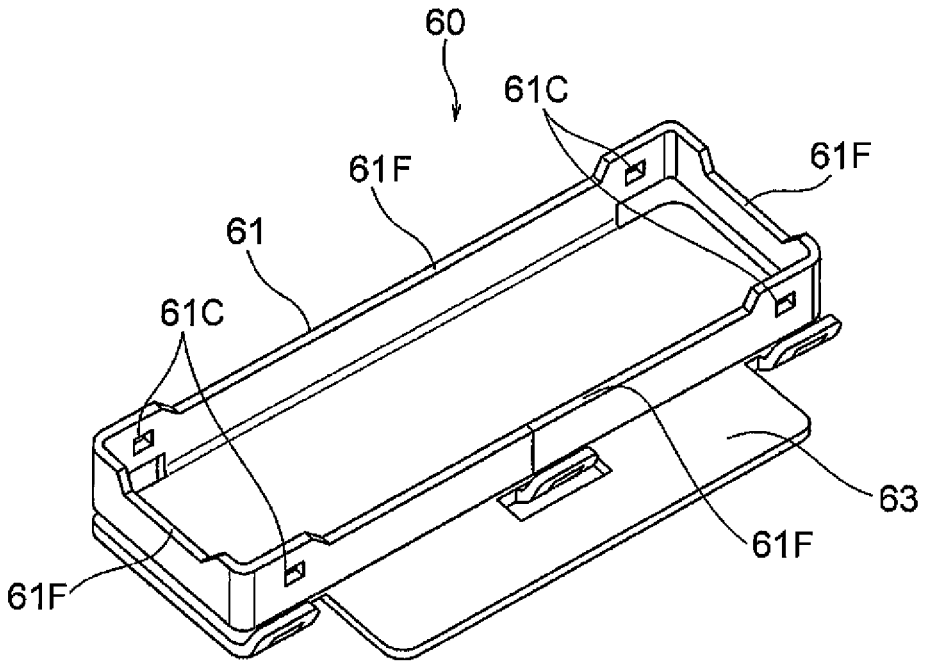
FIG. 6 is a perspective view showing the connector shown in FIG. 5, wherein the illustration of the engaging claws 61H is omitted.

As shown in FIG. 6, the frame member 61 of the connector 60 is provided with cutout portions 61F at positions corresponding to terminal portions 22A, soldered to conductive contact points of the PCB 200, of contacts 22 (FIG. 4) and corresponding to base portions 23B, soldered to metal lands of the PCB 200, of the locking members 23 (FIG. 4). With this configuration, when the connector 60 is fitted to the mating connector 20, it is prevented that the frame member 61 rides on soldered portions to disable proper fitting between the connector 60 and the mating connector 20 or that a short circuit occurs between the contacts 22 through the frame member 61.

A ground pattern 107 is formed on a second plate surface 112 of the FPC 100', including its region corresponding to the contacts 102 formed on the first plate surface 111. On the other hand, as described above, the frame member 61, the plate-like member 63, and the hinge portion 64 are conductive. Therefore, the frame member 61 is electrically connected to the ground pattern 107 through the hinge portion 64 and the plate-like member 63.

In order to ensure reliable contact between the ground pattern 107 of the FPC 100' and the plate-like member 63, a plurality of projections or a plurality of spring pieces may be provided on an inner surface of the plate-like member 63, preferably at positions corresponding to the contacts 102. By electrically connecting at least one of the frame member 61 and the plate-like member 63 to the ground pattern 107 of the FPC 100', the connector 60 and the mating connector 20 received therein can exhibit a shielding effect against noise coming from the outside and/or noise radiated to the outside.

As in the first embodiment, the locking members 23 (FIG. 4) of the mating connector 20 and the metal lands of the PCB 200 may be made of a conductive metal and the metal lands may be electrically connected to a non-illustrated ground pattern formed on the PCB 200, thereby electrically connecting the locking members 23 to the ground pattern. When the connector 60 is fitted to the mating connector 20, the locking claws 23C (FIG. 4) of the locking members 23 and the locking holes 61C of the frame member 61 are brought into contact with each other and therefore a connector system as a whole, comprising the connector 60 and the mating connector 20, can exhibit a shielding effect against noise coming from the outside and/or noise radiated to the outside.

In the connector 60 of the second embodiment, the frame member 61, the plate-like member 63, and the hinge portion 64 are integrally formed from the single metal plate. However, for example, if engaging claws and engaging holes are provided also on the hinge portion sides of the frame member 61 and the plate-like member 63 and configured to engage with each other, the hinge portion 64 is not necessarily required. That is, the frame member 61 and the plate-like member 63 are not necessarily integrally formed and may be separate members.

In each of the above-mentioned embodiments, the concave locking holes 11C, 61C are provided in the frame member 11, 61 while the convex locking claws 23C are provided in the mating connector 20. However, this structure may be reversed. That is, convex locking claws may be provided in the frame member 11, 61 while concave locking holes may be provided in the mating connector 20.

While this invention has been described with reference to the specific embodiments, it is needless to say that various changes can be made thereto within the scope not departing from the gist of this invention.

What is claimed is:

1. A connector which is attached to a plate-like connection object and adapted to be fitted to a mating connector, mounted on a surface of a mating connection object, in a direction perpendicular to the surface of the mating connection object, thereby electrically connecting the connection object to the mating connection object, the connector comprising:

a plurality of contacts formed on a first plate surface of the connection object;

a frame-shaped frame member which has an opening size and a height capable of receiving the mating connector and is attached to the first plate surface of the connection object so as to surround the plurality of contacts; and a plate-like member which is provided on a second plate surface of the connection object so as to extend over a region corresponding to the plurality of contacts and is joined to the frame member, wherein the frame member has a locking portion which engages with a mating locking portion provided in the mating connector when the connector is fitted to the mating connector, thereby maintaining a fitting state of the connector and the mating connector, and wherein the plate-like member is made of metal and is electrically connected to ground, thereby to allow the plate-like member to work as a shield.

2. The connector according to claim 1, wherein the frame member is made of a metal and soldered to metal lands formed at positions, surrounding the plurality of contacts, on the first plate surface of the connection object so that the frame member is joined to the plate-like member through the connection object.

3. The connector according to claim 2, wherein the frame member has a shape in which a portion, corresponding to the metal land of the connection object, of the frame member is projected outward.

4. The connector according to claim 2, wherein the metal land of the connection object is electrically connected to a ground pattern formed on the connection object, and wherein the frame member is electrically connected to the ground pattern through the metal land.

5. The connector according to claim 1, wherein the connection object is a circuit board, and wherein the plate-like member is formed using the circuit board itself.

6. The connector according to claim 1, wherein the frame member has a frame-side engaging portion and the plate-like member has a plate-like member-side engaging portion adapted to engage with the frame-side engaging portion, and wherein the frame member and the plate-like member are joined together by engagement between the frame-side engaging portion and the plate-like member-side engaging portion in a state where the connection object is sandwiched between the frame member and the plate-like member.

7. A connector system comprising the connector according to claim 1 and the mating connector.

8. A connector which is attached to a plate-like connection object and adapted to be fitted to a mating connector, mounted on a surface of a mating connection object, in a direction perpendicular to the surface of the mating connection object, thereby electrically connecting the connection object to the mating connection object, the connector comprising:

a plurality of contacts formed on a first plate surface of the connection object, the plurality of contacts being a matrix of contacts, each contact of the matrix corresponding to, on a one-on-one basis, one contact of contacts of the mating connector, the matrix being an m-by-n matrix where m and n are greater than or equal to 2;

a frame-shaped frame member which has an opening size and a height capable of receiving the mating connector and is attached to the first plate surface of the connection object so as to surround the plurality of contacts; and a plate-like member which is provided on a second plate surface of the connection object so as to extend over a region corresponding to the plurality of contacts and is joined to the frame member, wherein the frame member has a locking portion which engages with a mating locking portion provided in the mating connector when the connector is fitted to the mating connector, thereby maintaining a fitting state of the connector and the mating connector.

9. A connector which is attached to a plate-like connection object and adapted to be fitted to a mating connector, mounted on a surface of a mating connection object, in a direction perpendicular to the surface of the mating connection object, thereby electrically connecting the connection object to the mating connection object, the connector comprising:

a plurality of contacts formed on a first plate surface of the connection object;

a frame-shaped frame member which has an opening size and a height capable of receiving the mating connector and is attached to the first plate surface of the connection object so as to surround the plurality of contacts; and a plate-like member which is provided on a second plate surface of the connection object so as to extend over a region corresponding to the plurality of contacts and is joined to the frame member, wherein the frame member has a locking portion which engages with a mating locking portion provided in the mating connector when the connector is fitted to the mating connector, thereby maintaining a fitting state of the connector and the mating connector, wherein the frame member has a frame-side engaging portion and the plate-like member has a plate-like member-side engaging portion adapted to engage with the frame-side engaging portion, wherein the frame member and the plate-like member are joined together by engagement between the frame-side engaging portion and the plate-like member-side engaging portion in a state where the connection object is sandwiched between the frame member and the plate-like member, wherein one side of the frame member and one side of the plate-like member are joined to each other through a hinge portion so that the frame member and the plate-like member can be opened and closed, and wherein, by engagement between the frame-side engaging portion and the plate-like member-side engaging portion in a state where the frame member and the plate-like member are closed to each other about the hinge portion so as to sandwich the connection object therebetween, the frame member and the plate-like member are joined to each other also at a portion other than along the sides thereof.

10. The connector according to claim 9, wherein the frame member, the plate-like member, and the hinge portion are in the form of a single component formed by using a common material.

11. The connector according to claim 9, wherein a ground pattern is formed on the second plate surface of the connection object, including its region corresponding to the plurality of contacts formed on the first plate surface of the connection object, wherein the frame member, the plate-like member, and the hinge portion are each made of a metal, and wherein the frame member is electrically connected to the ground pattern through the hinge portion and the plate-like member.

* * * * *